US009972931B1

(12) United States Patent
Chen

(10) Patent No.: US 9,972,931 B1
(45) Date of Patent: May 15, 2018

(54) MALE-FEMALE MUTUALLY-PLUGGABLE CONNECTOR

(71) Applicant: Xiamen GHGM Industrial Trade Co., Ltd., Xiamen (CN)

(72) Inventor: Bingshui Chen, Xiamen (CN)

(73) Assignee: XIAMEN GHGM INDUSTRIAL TRADE CO., LTD., Xiamen, Fujian (CN)

( * ) Notice: Subject to any disclaimer, the term of this patent is extended or adjusted under 35 U.S.C. 154(b) by 0 days. days.

(21) Appl. No.: 15/655,917

(22) Filed: Jul. 21, 2017

(30) Foreign Application Priority Data

Jan. 17, 2017 (CN) ..... 2017 1 0031669

(51) Int. Cl.

| | |
|---|---|
| ***H01R 13/11*** | (2006.01) |
| ***H01R 13/04*** | (2006.01) |
| ***H01R 4/48*** | (2006.01) |
| ***H01R 13/28*** | (2006.01) |

(52) U.S. Cl.
CPC ..... *H01R 13/112* (2013.01); *H01R 4/4818* (2013.01); *H01R 13/04* (2013.01); *H01R 13/28* (2013.01)

(58) Field of Classification Search
CPC ..... H01R 4/4818; H01R 4/26; H01R 13/28; H01R 23/27
USPC ..... 439/441, 290, 291
See application file for complete search history.

(56) References Cited

U.S. PATENT DOCUMENTS

| | | | | | |
|---|---|---|---|---|---|
| 2,389,115 | A | * | 11/1945 | Anderson | H01R 13/28 24/590.1 |
| 2,554,876 | A | * | 5/1951 | Olson | H01R 13/28 403/345 |
| RE23,547 | E | * | 9/1952 | Fox | H01R 13/28 439/290 |
| 2,762,022 | A | * | 9/1956 | Benander | H01R 13/28 439/290 |
| 3,070,769 | A | * | 12/1962 | Murphy | H01R 13/28 439/291 |
| 3,202,954 | A | * | 8/1965 | Kinkaid | H01R 4/185 439/281 |
| 3,440,596 | A | * | 4/1969 | Frompovicz | H01R 13/28 439/290 |
| 3,523,273 | A | * | 8/1970 | Hammell | H01R 13/28 439/249 |
| 3,654,594 | A | * | 4/1972 | Sitzler | H01R 4/185 439/857 |

(Continued)

*Primary Examiner* — Tulsidas C Patel
*Assistant Examiner* — Travis Chambers
(74) *Attorney, Agent, or Firm* — Leong C. Lei

(57) ABSTRACT

A male-female mutually-pluggable connector includes first and second plastic cores and first and second metal spring plates. The first and second metal spring plates are each formed, on one end portion thereof, with plugging spring plates, and are also formed, on an opposite end thereof, with a wire insertion spring plate having a curved part. At least one of first and second metal spring plates is formed, in the one end portion thereof, with a slot and the slot has an opening having opposite sides that are raised and protruding to each other to form the plugging spring plates. The first and second metal spring plates are fixed in the first and second plastic cores, respectively. The plugging spring plates of the first and second metal spring plates are inter-plugged with each other to form a crossing form.

20 Claims, 20 Drawing Sheets

(56) References Cited

U.S. PATENT DOCUMENTS

| | | | | |
|---|---|---|---|---|
| 3,885,849 | A * | 5/1975 | Bailey | H01R 13/506<br>439/320 |
| 4,278,313 | A * | 7/1981 | Blakesley | H01R 13/28<br>439/290 |
| 7,179,095 | B1 * | 2/2007 | Peng | H01R 12/7052<br>439/290 |
| 7,938,696 | B2 * | 5/2011 | Genau | H01R 12/716<br>439/290 |
| 8,079,863 | B2 * | 12/2011 | Wason | H01R 11/09<br>439/284 |
| 8,251,758 | B2 * | 8/2012 | Yoshida | H01R 13/28<br>439/290 |
| 9,748,674 | B2 * | 8/2017 | Xu | H01R 4/4836 |
| 2009/0311898 | A1 * | 12/2009 | Rozet | H01R 13/05<br>439/291 |

* cited by examiner

MALE-FEMALE MUTUALLY-PLUGGABLE CONNECTOR

(a) TECHNICAL FIELD OF THE INVENTION

The present invention relates generally to power connection techniques, and more particularly to a male-female mutually-pluggable connector.

(b) DESCRIPTION OF THE PRIOR ART

In the state of the art, electrical connection between components of electrical devices is often achieved through soldering a conductor. Such a conductor soldering solution requires a complicated process and the efficiency of assembly is low and defect rate is high, and consequently, stability of electrical connection is often affected. Thus, the present inventor has developed a conveniently and fast connectable male-female mutually pluggable connector and this invention is created accordingly.

SUMMARY OF THE INVENTION

An objective of the present invention is to provide a male-female mutually-pluggable connector, which has a simple structure and greatly simplifies connection assembly between wires.

In an aspect of the present invention, a male-female mutually-pluggable connector comprises a first plastic core, a second plastic core, first metal spring plates, and second metal spring plates, wherein the first metal spring plates and the second metal spring plates are each provided, on one end thereof, with plugging spring plates and are provided, on an opposite end, with a curved wire insertion spring plate, at least one of the first metal spring plates and the second metal spring plates being formed, in one end portion thereof, with a slot such that the slot has an opening having opposite sides raised and protruding toward each other to form the plugging spring plates; the first plastic core comprises a base seat and insertion legs, the base seat being formed therein with first wire holes for receiving insertions of conductor wires, the insertion legs being formed with first insertion holes in communication with the first wire holes, the first insertion holes respectively receiving and fixing the first metal spring plates therein at a middle thereof such that the plugging spring plates of the first metal spring plates are located in the first insertion holes and the wire insertion spring plates of the first metal spring plates are located in the first wire holes for receiving the insertion of the conductor wires; the second plastic core has one end formed with second wire holes for receiving insertion of conductor wires, the second plastic core having an opposite end forming a socket, wherein the socket comprises second insertion holes formed therein for receiving the insertion legs to plug therein, the second insertion holes respectively receiving and fixing the second metal spring plates therein at a middle thereof such that the plugging spring plates of the second metal spring plates are located in the second insertion hole to allow the plugging spring plates of the first metal spring plates and the plugging spring plates of the second metal spring plates to intersect with each other in a crossing configuration, the wire insertion spring plates of the second metal spring plates being located in the second wire holes to receive the insertion of and connection with the conductor wires; wherein when the insertion legs of the first plastic core are plugged into the second insertion holes of the socket of the second plastic core, the plugging spring plates of the first metal spring plates and the second metal spring plates are inter-plugged into each other and coupled together to realize wire-to-wire electrical connection.

In the first aspect, the wire insertion spring plates of the second metal spring plates are integrally formed with the plugging spring plates; or the wire insertion spring plates of the second metal spring plates are separate from the plugging spring plates and wire insertion spring plates cooperate with extension sections of the plugging spring plates to receive the conductor wires to insert therein; or the wire insertion spring plate of one of the first metal spring plate and the second metal spring plate is integrally formed with the plugging spring plate, while that of the other one is separate from the plugging spring plate, wherein the separate wire insertion spring plate cooperates an extension section of the plugging spring plate to receive the conductor wire to insert therein.

In the first aspect, the first insertion holes of the first plastic core each have an inside wall in which first fixing grooves are formed, the first metal spring plate being inserted into the first fixing grooves to divide the first insertion hole into two halves, wherein one of the two halves of the first insertion hole where the insertion spring plates of the first metal spring plate are located is in communication with the first wire hole.

In the first aspect, the second insertion holes of the second plastic core are each provided therein with two support pillars that are opposite to each other and are spaced from each other by a predetermined gap, the two support pillars formed with second fixing grooves, the second metal spring plate being inserted into the second fixing grooves, such that the plugging spring plates of the second metal spring plates correspond to the gap of the support pillars, wherein the second insertion hole is set in communication with the second wire hole at a location corresponding to the wire insertion spring plates of the second metal spring plate.

In a second aspect of the present invention, a male-female mutually-pluggable connector comprises a first plastic core, a second plastic core, first metal spring plates, and the second metal spring plates, wherein the first metal spring plates and the second metal spring plates are each provided, on one end thereof, with plugging spring plates, the first metal spring plates and the second metal spring plates being respectively provided, on an opposite end thereof, with a soldering leg and a curved wire insertion spring plate, at least one of the first metal spring plates and the second metal spring plates being formed, at one end portion thereof, with a slot, the slot having an opening having opposite sides raised and protruding toward each other to form the plugging spring plates; the first plastic core comprises a base seat and insertion legs, the insertion legs being formed with first insertion holes extending through the base seat, the first insertion holes receiving and fixing, in a middle thereof, the first metal spring plate, such that the plugging spring plates of the first metal spring plates are located in the first insertion hole and an opposite end of the first metal spring plate extends through the first insertion hole and projects out of the base seat to be curved to form the soldering leg for connection with a printed circuit board (PCB); the second plastic core has an end formed with second wire holes for receiving insertion of conductor wires, the second plastic core having an opposite end that forms a socket, the socket comprising second insertion holes formed therein for receiving the insertion legs to plug therein, the second insertion holes receiving and fixing, in a middle thereof, the second metal spring plates, such that the plugging spring plates of the second metal spring plates are located in the second insertion holes to allow the plugging spring plates of the first metal spring plates and the plugging spring plates of the second metal spring plates to intersect each other in a crossing configuration, the wire insertion spring plates of the second metal spring plates being located in the second wire holes for receiving insertion of and connection with the conductor wires; wherein when the insertion legs of the first plastic core are plugged into the second insertion holes of the socket of the second plastic core, the plugging spring plates of the first metal spring plates and the second metal spring plates are inter-plugged into each other and coupled together to realize wire-to-board electrical connection.

In a third aspect of the present invention, a male-female mutually-pluggable connector comprises a first plastic core, a second plastic core, first metal spring plates, and the second metal spring plates, wherein the first metal spring plates and the second metal spring plates are each provided, on one end thereof, with plugging spring plates, the first metal spring plates and the second metal spring plates being respectively provided, on an opposite end thereof, with a soldering leg and a curved wire insertion spring plate, at least one of the first metal spring plates and the second metal spring plates being formed, at one end portion thereof, with a slot, the slot having an opening having opposite sides raised and protruding toward each other to form the plugging spring plates; the first plastic core comprises a base seat and insertion legs, the base seat being formed with first wire holes for receiving insertion of conductor wires, the insertion legs being formed with first insertion holes in communication with the first wire holes, the first insertion holes receiving and fixing, in a middle thereof, the second metal spring plates, such that the plugging spring plates of the second metal spring plates are located in the first insertion holes and the wire insertion spring plates of the second metal spring plates are located in the first wire holes for receiving insertion of conductor wires; the second plastic core has one end forming a socket, the socket comprising second insertion holes extending through the second plastic core for receiving the insertion legs to plug therein, the second insertion holes receiving and fixing, in a middle thereof, with first metal spring plates, such that the plugging spring plates of the first metal spring plates are located in the second insertion hole to allow the plugging spring plates of the first metal spring plates and the plugging spring plates of the second metal spring plates to intersect each other in a crossing configuration, the first metal spring plates having an opposite end extending through the second insertion holes to project out of an end of the second plastic core to be curved to form a soldering leg for connection with a printed circuit board (PCB); wherein when the insertion legs of the first plastic core are plugged into the second insertion holes of the socket of the second plastic core, the plugging spring plates of the first metal spring plates and the second metal spring plates are inter-plugged into each other and coupled together to realize wire-to-board electrical connection.

In the second and third aspects, the opposite end of the first metal spring plates is curved sideways to form the soldering leg, the soldering leg and the plugging spring plates being located on the same plane; or the opposite end of the first metal spring plates is curved downward to form the soldering leg, the soldering leg defining an included angle with respect to a plane on which the plugging spring plates are located.

In the second and third aspects, the first plastic core or the second plastic core is formed with positioning and retention grooves corresponding to the soldering leg to receive insertion of the soldering legs for fixing.

In the second and third aspects, the wire insertion spring plates of the second metal spring plates are integrally formed with the plugging spring plates; or the wire insertion spring plates of the second metal spring plates are separate from the plugging spring plates and wire insertion spring plates cooperate with extension sections of the plugging spring plates to receive the conductor wires to insert therein.

In the second and third aspects, the insertion holes of the first plastic core each have an inside wall in which first fixing grooves are formed, the first metal spring plate or the second metal spring plate being inserted into the first fixing grooves.

In the second and third aspects, the second insertion holes of the second plastic core are each provided therein with two support pillars that are opposite to each other and have a predetermined gap therebetween. The two support pillars are formed with second fixing grooves opposite to each other. The first metal spring plate or the second metal spring plate is inserted into the second fixing grooves such that the plugging spring plates of the first metal spring plate or the second metal spring plate correspond to the gap of the support pillars.

In the first, second, and third aspects, an outer surface of the insertion legs of the first plastic core and an inside wall of the second insertion holes of the socket of the second plastic core are respectively formed with retention blocks corresponding to and engageable with each other so that help secure the first plastic core and the second plastic core fixedly in position after insertion to each other.

In the first, second, and third aspects, the first metal spring plates and the second metal spring plates are formed with barbs and the first plastic core and the second plastic core are formed therein with corresponding positioning blocks such that the barbs and the positioning blocks are collaboratively engageable with each other to more securely fix the first metal spring plates and the second metal spring plates in the first plastic core and the second plastic core.

In the first, second, and third aspects, the first metal spring plates and the second metal spring plates are each formed with an introduction guide angle and a withdrawal guide angle at an entrance opening of the plugging spring plates to allow for easy insertion and withdrawal.

In the first, second, and third aspects, the first plastic core comprises two first insertion legs, and correspondingly, the socket of the second plastic core comprises two second insertion holes.

Based on the above technical solutions, the present invention has a simple structure. The solution of the firsts aspect is applied such that one conductor wire is inserted into the first wire hole to form electrical connection with the wire insertion spring plate of the first metal spring plates, and another conductor wire is inserted into the second wire hole to form electrical connection with the wire insertion spring plate of the second metal spring plate. And, then the insertion leg of the first plastic core is plugged into the second insertion hole of the socket of the second plastic core such that the plugging spring plates of the first metal spring plate and the plugging spring plates of the second metal spring plate are inter-plugged into each other and coupled together to realize wire-to-wire electrical connection. The solutions of the second and third aspects are applied such that a printed circuit board (PCB) and a conductor wire are respectively set into electrical connection with the soldering leg and the wire insertion spring plate of the first metal spring plate and the second metal spring plate. And, then, the insertion leg of the first plastic core is plugged into the second insertion hole of the socket of the second plastic core such that the plugging spring plates of the first metal spring plate and the plugging spring plates of the second metal spring plate are inter-plugged into each other and coupled together to realize wire-to-board electrical connection.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 2-1 and FIG. 2-2 are respectively a perspective view and a side elevational view of first metal spring plates and second metal spring plates of the first embodiment;

FIG. 3-1 to FIG. 3-6 are respectively perspective views, a front view, a cross-sectional view taken along line A-A, a side elevational view, and a cross-sectional view taken along line B-B of the first metal spring plates and a first plastic core assembled together according to the first embodiment;

FIG. 4-1 to FIG. 4-6 are respectively perspective views, a front view, a cross-sectional view taken along line A-A, a side elevational view, and a cross-sectional view taken along line B-B of the second metal spring plates and a second plastic core assembled together according to the first embodiment;

FIG. 5 is a cross-sectional view of a second embodiment of the present invention in an assembled form;

FIG. 6-1 and FIG. 6-2 are respectively a perspective view and a side elevational view of first metal spring plates of the second embodiment;

FIG. 7-1 to FIG. 7-6 are respectively perspective views, a front view, a cross-sectional view taken along line A-A, a side elevational view, and a cross-sectional view taken along line B-B of the first metal spring plates and a first plastic core assembled together according to the second embodiment;

FIG. 8-1 to FIG. 8-6 are respectively perspective views, a front view, a cross-sectional view taken along line A-A, a side elevational view, and a cross-sectional view taken along line B-B of the second metal spring plates and a second plastic core assembled together according to the second embodiment;

FIG. 11-1 to FIG. 11-6 are respectively perspective views, a front view, a cross-sectional view taken along line A-A, a side elevational view, and a cross-sectional view taken along line B-B of the first metal spring plates and a first plastic core assembled together according to the third embodiment;

FIG. 12-1 to FIG. 12-6 are respectively perspective views, a front view, a cross-sectional view taken along line A-A, a side elevational view, and a cross-sectional view taken along line B-B of the second metal spring plates and a second plastic core assembled together according to the third embodiment; and FIG. 13-1 to FIG. 13-4 are respectively perspective views of other forms (unitary or separate) of the second metal spring plates and a cross-sectional view showing an assembled condition of the separate configuration.

DETAILED DESCRIPTION OF THE PREFERRED EMBODIMENTS

Figure 1:
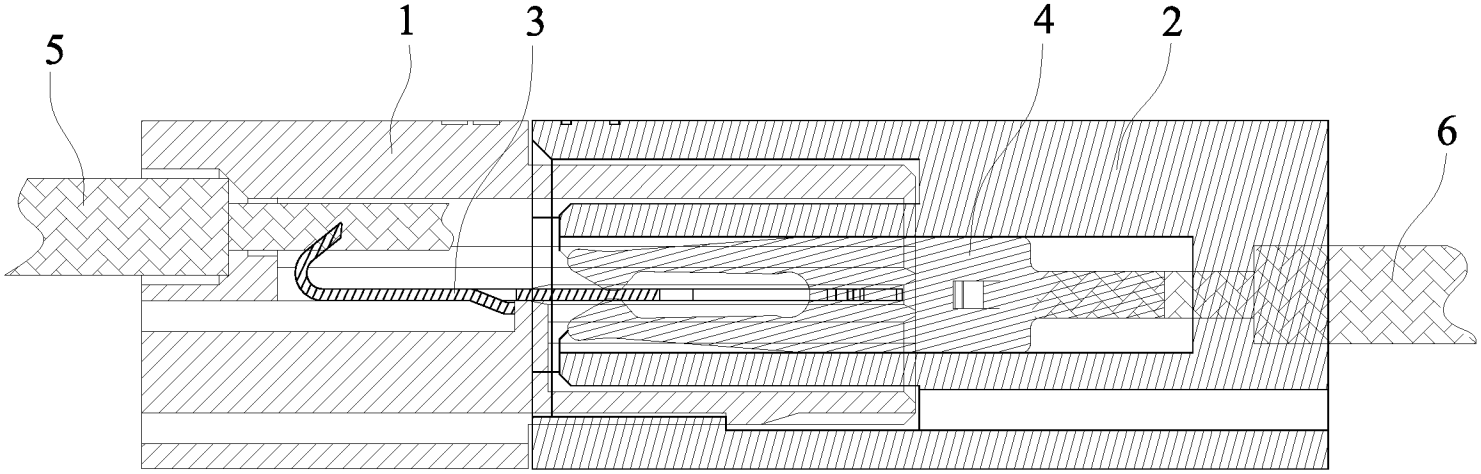
FIG. 1 is a cross-sectional view of a first embodiment of the present invention in an assembled form.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIG. 1 to FIG. 4-6, an embodiment of the present invention discloses a wire-to-wire male-female mutually-pluggable connector, which comprises a first plastic core 1, a second plastic core 2, first metal spring plates 3, and second metal spring plates 4.

In the instant embodiment, the first metal spring plates 3 and the second metal spring plates 4 are of identical structures, which have an end portion in which a slot 31, 41 formed such that an opening of the slot 31, 41 is formed with plugging spring plates 32, 42 that are protruded toward and opposite to each other, and an opposite end portion that is bent or curved to form an integrally formed wire insertion spring plate 33, 43. The plugging spring plates 32, 42 have an outside configuration similar to a fishing spear and thus, the first metal spring plates 3 and the second metal spring plates 4 are also referred to as spear terminals.

The first plastic core 1 comprises a base seat 11 and insertion legs 12. The base seat 11 is formed therein with first wire holes 13 for receiving insertion of conductor wires 5 therein. The insertion legs 12 are respectively formed with first insertion holes 14 that are connected to and in communication with the first wire holes 13, respectively. The first insertion holes 14 receive and fix the first metal spring plates 3 therein, respectively, such that the plugging spring plates 32 of the first metal spring plates 3 are located in the first insertion holes 14 and the wire insertion spring plates 33 of the first metal spring plates 3 extend into the first wire hole 13 for receiving the insertion of and establishing connection with the conductor wires 5.

The second plastic core 2 has one end formed with second wire holes 21 for receiving insertion of conductor wires 6 therein. The second plastic core 2 has an opposite end formed as a socket 22. The socket 22 comprises second insertion holes 23 that receive the insertion legs 12 to plug therein. The second insertion holes 23 receive and fix the second metal spring plates 4 therein, respectively, at a middle of each of the second insertion hole. The plugging spring plates 42 of the second metal spring plates 4 are located in the second insertion holes 23 such that the plugging spring plates 32 of the first metal spring plates 3 and the plugging spring plates 42 of the second metal spring plates 4 are allowed, through insertion, to intersect each other to form a crossing arrangement. The wire insertion spring plates 43 of the second metal spring plates 4 extend into the second wire holes 21 for receiving insertion of and establishing connection with the conductor wires 6.

To use the first embodiment of the present invention discussed above, the conductor wires 5 are inserted into the first wire holes 13 to physically engage the wire insertion spring plates 33 of the first metal spring plates 3 and thus form electrical connection therebetween; and the conductor wires 6 are inserted into the second wire holes 21 to physically engage the wire insertion spring plates 43 of the second metal spring plates 4 and thus form electrical connection therebetween. Then, the insertion legs 12 of the first plastic core 1 are respectively inserted into the second insertion holes 23 of the socket 22 of the second plastic core 2 such that the plugging spring plates 32 of the first metal spring plates 3 and the plugging spring plates 42 of the second metal spring plates 4 are inter-plugged into each other and coupled together to realize electrical connection therebetween. This helps greatly simplify electrical connection of one wire (cable) to another wire (cable).

To simplify assembly and fixation, the first embodiment of the present invention comprises the following improved designs, which help molding, processing, and assembling, and make a stable structure to achieve secure electrical connection and saving of material.

The first insertion holes 14 of the first plastic core 1 are each formed, in an inside wall thereof, with first fixing grooves 15, and the first metal spring plate 3 is inserted into the first fixing grooves 15 so as to divide the first insertion hole 14 into two halves, wherein the first insertion hole 14 is in communication with the first wire hole 13 in one of the two halves in which the wire insertion spring plates 33 of the first metal spring plates 3 are located.

The second insertion holes 23 of the second plastic core 2 are each formed therein with two support pillars 24 that are opposite to each other and have a predetermined gap formed therebetween. The two support pillars 24 are respectively formed with second fixing grooves 25 that are opposite to each other. The second metal spring plate 4 is inserted into the second fixing grooves 25 such that the plugging spring plates 42 of the second metal spring plate 4 correspond exactly to the gap between the two support pillars 24. The gap allows the plugging spring plates 32 of a corresponding one of the first metal spring plates 3 to insert therein, wherein the second insertion hole 23 is set in communication with the second wire hole 21 at a location corresponding to the wire insertion spring plates 33 of the second metal spring plate 4.

Figures 1, 2:
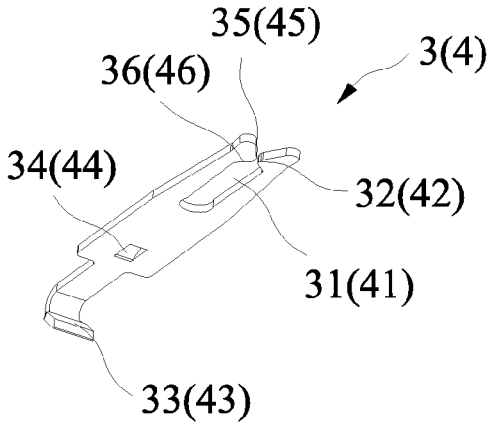
Figure 2:
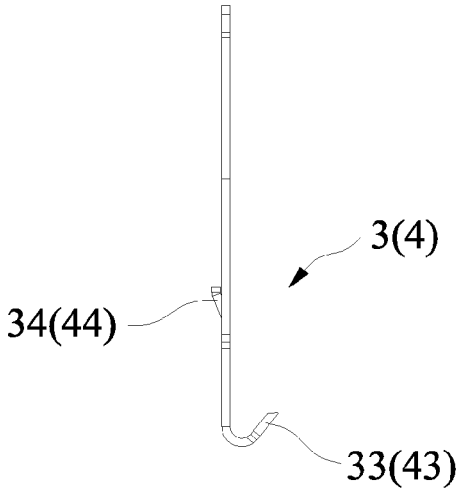
Figures 1, 3:
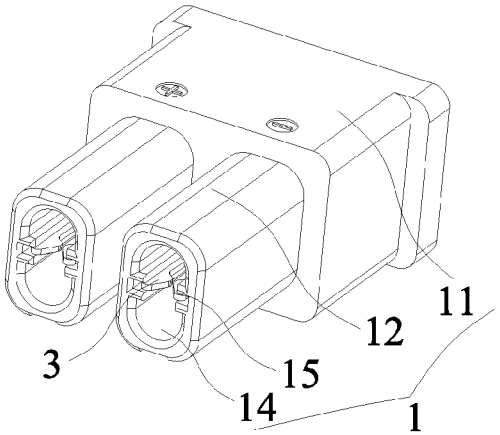
Figures 2, 3:
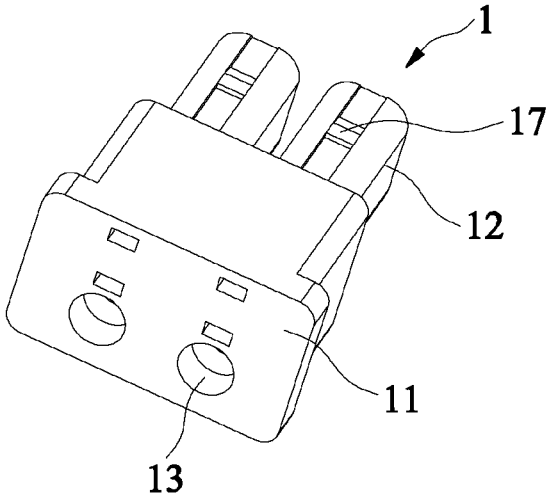
Figure 3:
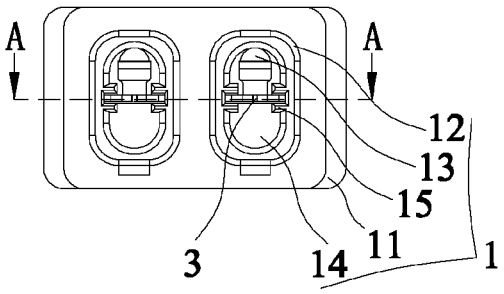
Figures 3, 4:
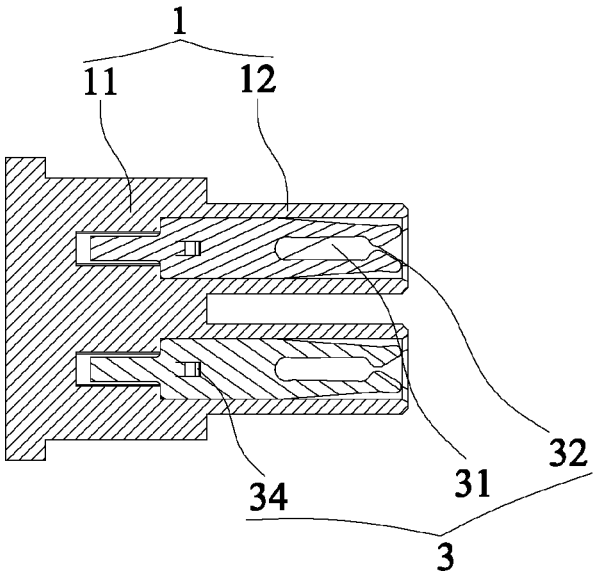
Figures 3, 4, 5:
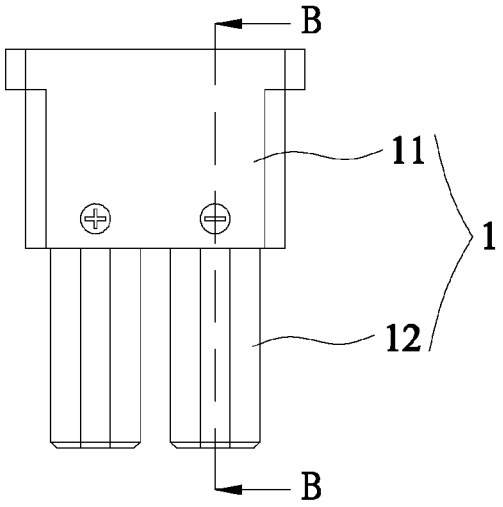
Figures 3, 4, 5, 6:
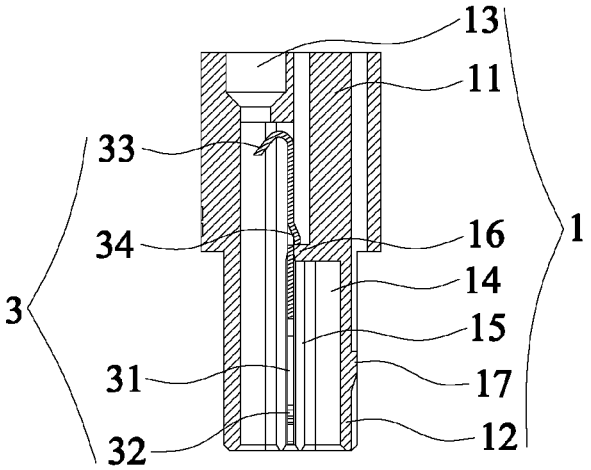
Figures 1, 4:
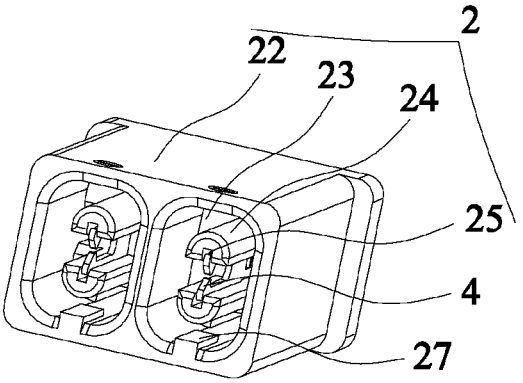
Figures 2, 4:
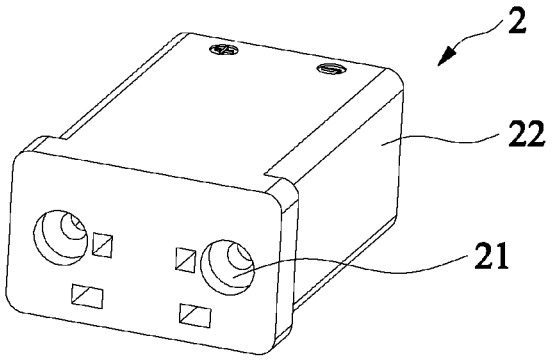
Figures 3, 4:
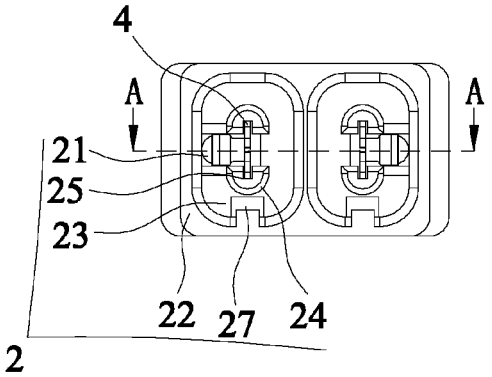
Figure 4:
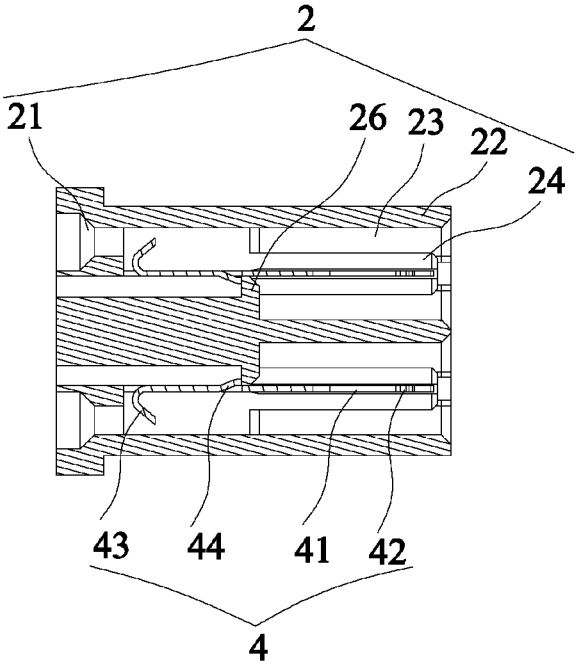
Figures 4, 5:
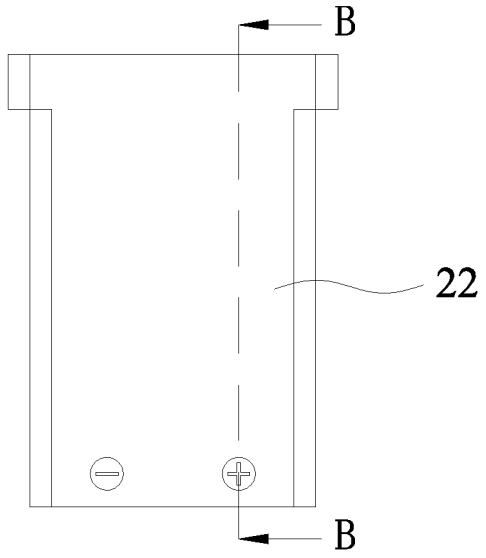
Figures 4, 5, 6:
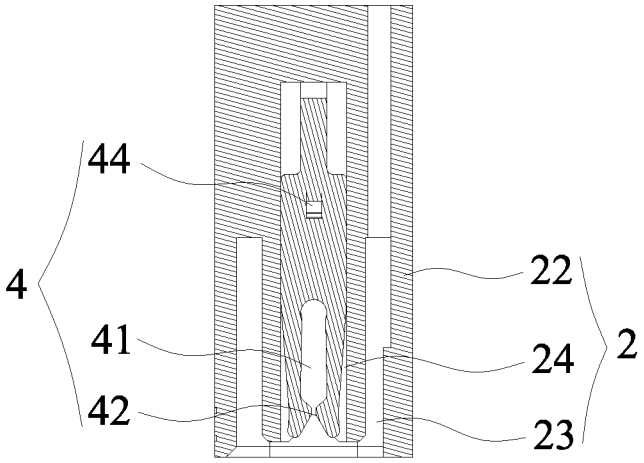
Figure 5:
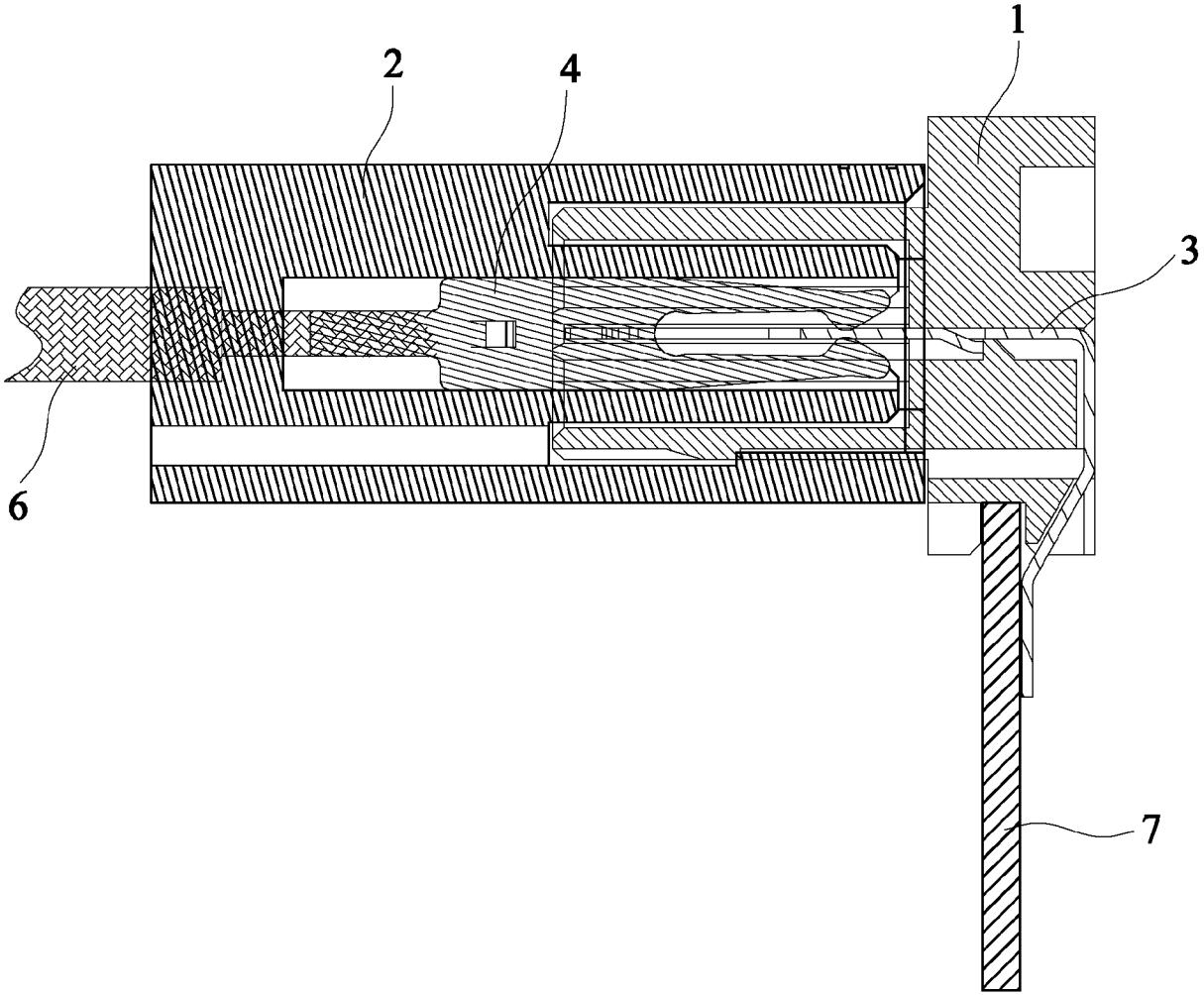
Figures 1, 6:
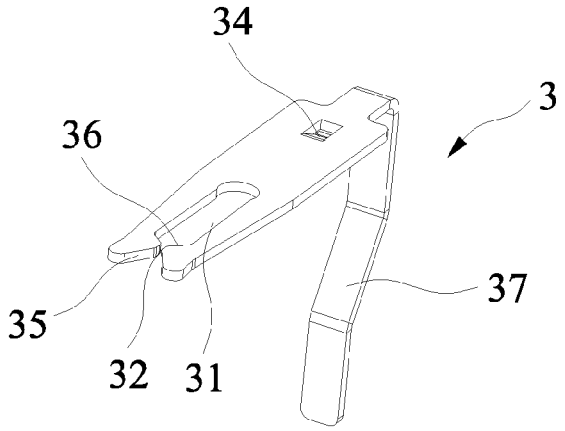
Figures 2, 6:
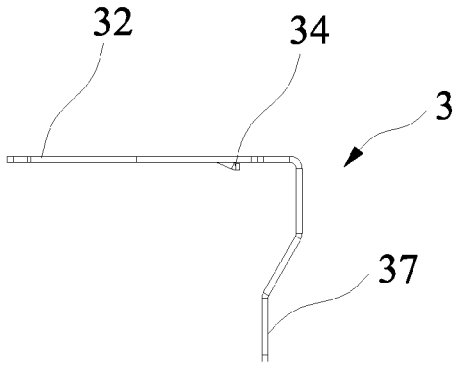
Figures 1, 7:
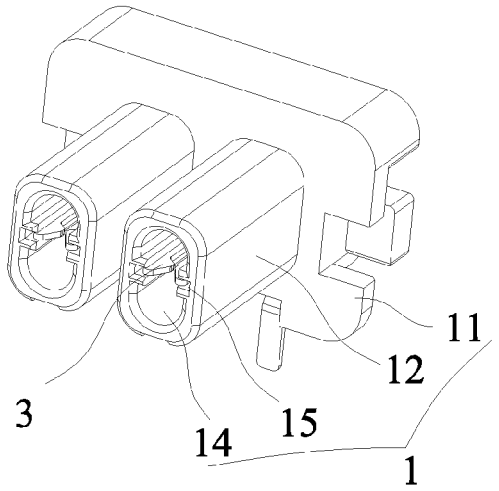
Figures 2, 7:
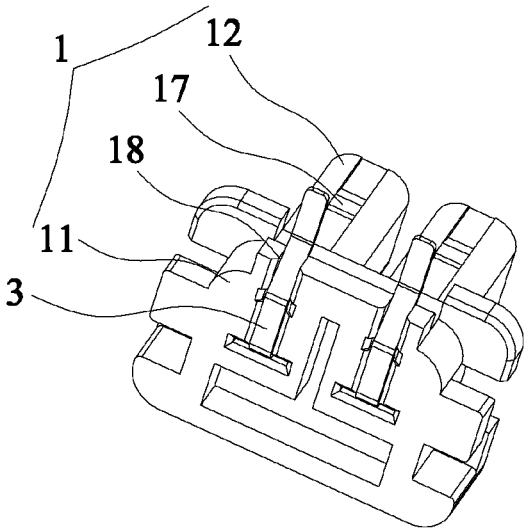
Figures 3, 7:
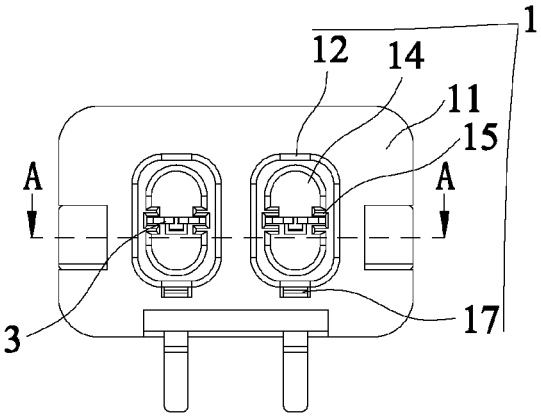
Figures 4, 7:
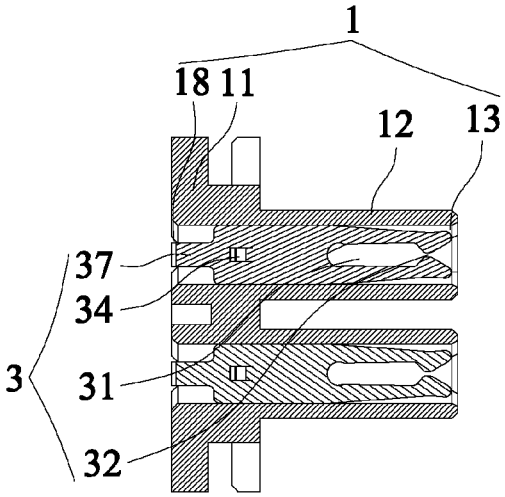
Figures 5, 7:
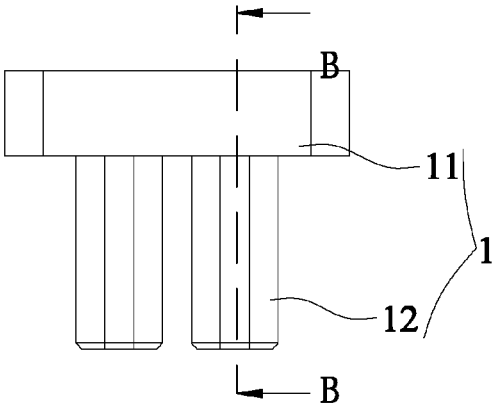
Figures 6, 7:
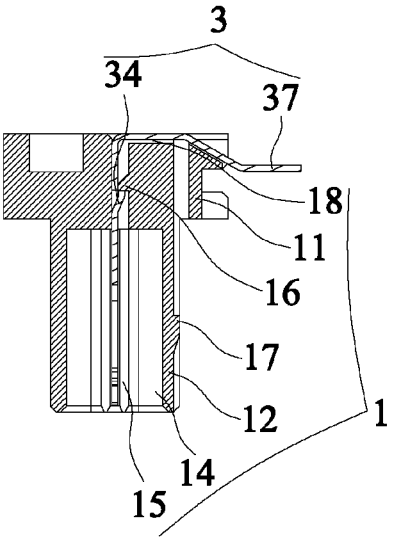
Figures 1, 8:
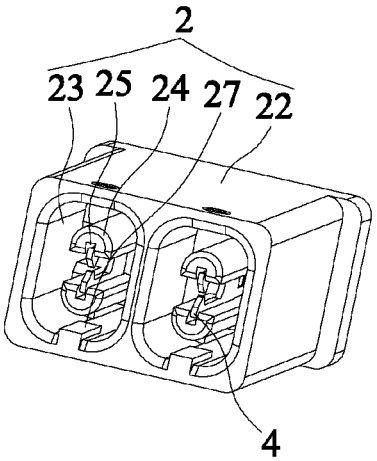
Figures 2, 8:
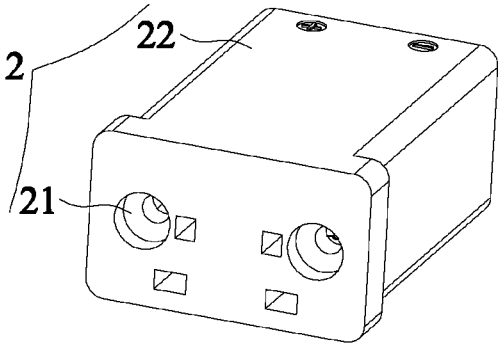
Figures 3, 8:
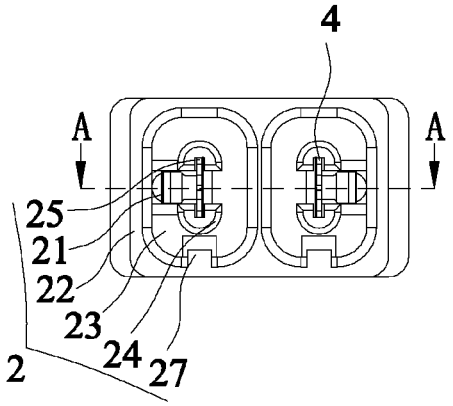
Figures 4, 8:
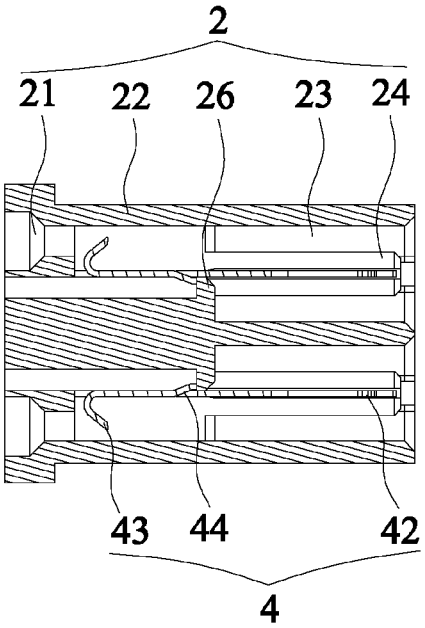
Figures 5, 8:
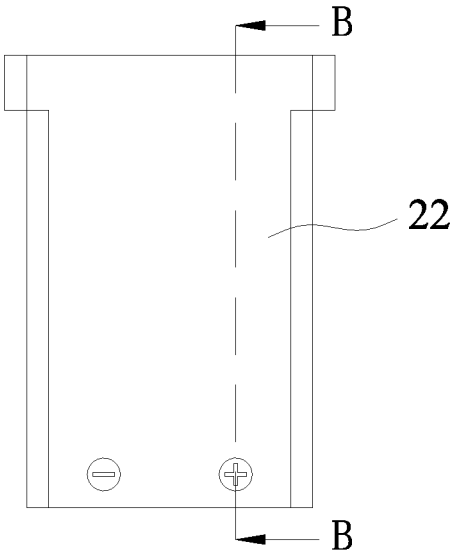
Figures 6, 8:
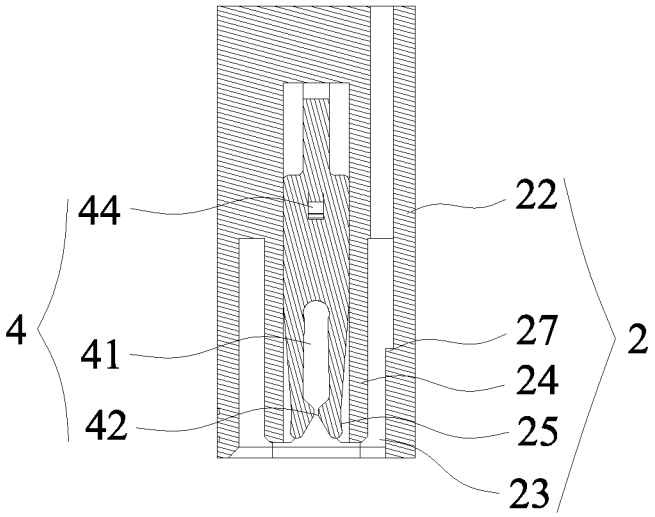
Figure 9:
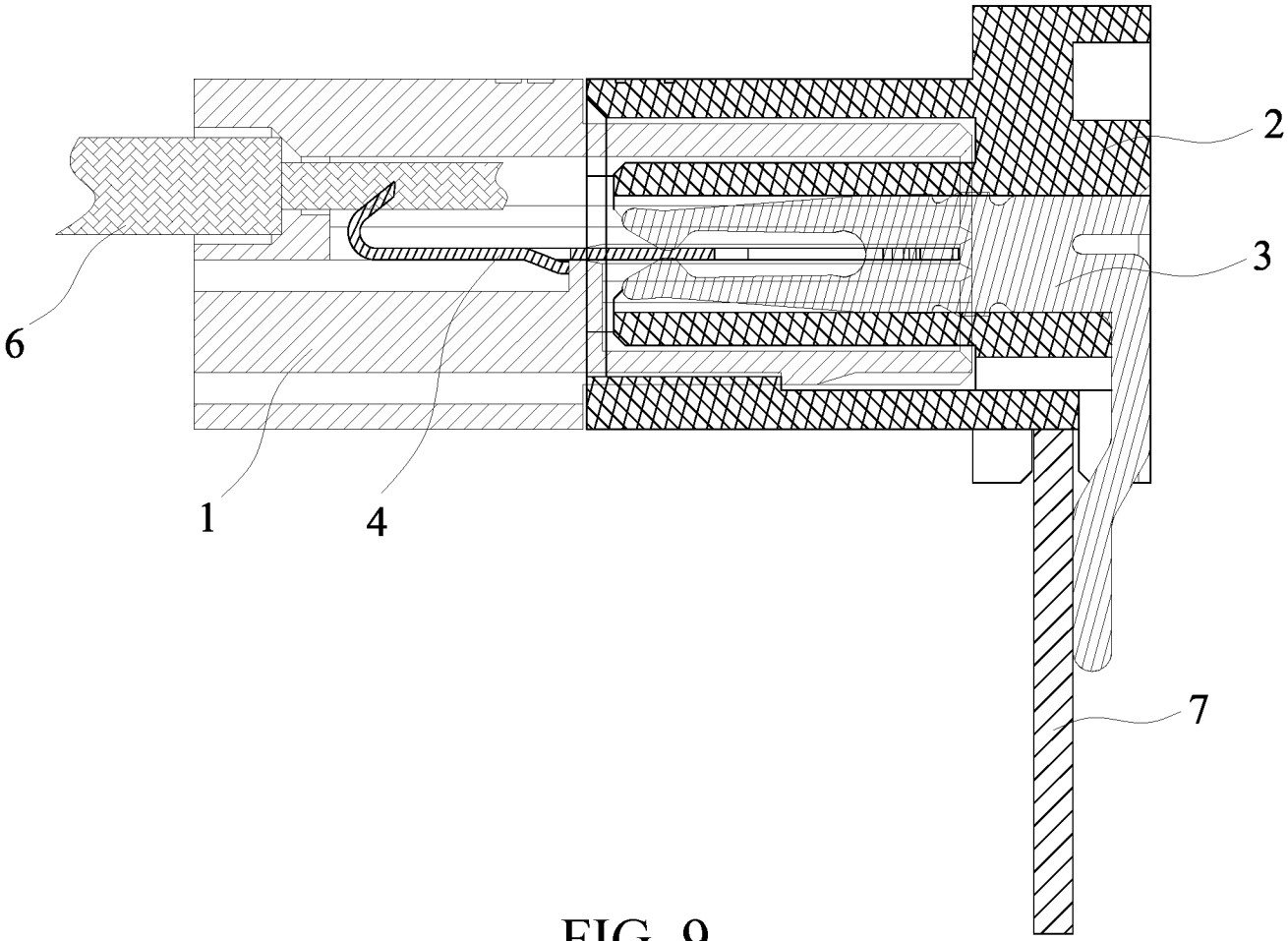
FIG. 9 is a cross-sectional view of a third embodiment of the present invention in an assembled form.

As shown in FIG. 5 to FIG. 8-6, a second embodiment of the present invention is shown, providing a wire-to-board male-female mutually-pluggable connector, which comprises a first plastic core 1, a second plastic core 2, first metal spring plates 3 (as shown in FIG. 6-1 and FIG. 6-2), and second metal spring plates 4 (similar to the counterparts of the first embodiment as shown in FIG. 2-1 and FIG. 2-2).

The first metal spring plates 3 and the second metal spring plates 4 are each formed with a slot 31, 41 in one end portion thereof such that the slot 31, 41 has an opening that is formed with plugging spring plates 32, 42 that are protruded toward and opposite to each other. The first metal spring plates 3 are formed, at an opposite end thereof, with a bent or curved soldering leg 37, while the second metal spring plates 4 are formed, at an opposite end thereof, with a curved or bent wire insertion spring plate 43. The plugging spring plates 32, 42 have an outside configuration similar to a fishing spear and thus, the first metal spring plates 3 and the second metal spring plates 4 are also referred to as spear terminals. In the instant embodiment, said opposite end of the first metal spring plates 3 is bent or curved downwards to form the soldering leg 37, such that the soldering leg 37 defines an included angle with a plane on which the plugging spring plates 32 are located. This structure helps save more material.

The first plastic core 1 comprises a base seat 11 and insertion legs 12. The insertion legs 12 are formed therein with first insertion holes 14 that extend through the base seat 11. The first insertion hole 14 receive and fix the first metal spring plates 3 therein such that the plugging spring plates 32 of the first metal spring plates 3 are located in the first insertion hole 14 and an opposite end of the first metal spring plates 3 extends through the first insertion holes 14 and project out of the base seat 11 to be bent or curved to form the soldering leg 37 for connection with a printed circuit board (PCB) 7.

The second plastic core 2 has one end formed with second wire holes 21 for receiving insertion of conductor wires 6 therein. The second plastic core 2 has an opposite end formed as a socket 22. The socket 22 comprises second insertion holes 23 that receive the insertion legs 12 to plug therein. The second insertion holes 23 receive and fix the second metal spring plates 4 therein, respectively, at middle thereof. The plugging spring plates 42 of the second metal spring plates 4 are located in the second insertion holes 23 such that the plugging spring plates 32 of the first metal spring plates 3 and the plugging spring plates 42 of the second metal spring plates 4 are allowed, through insertion, to intersect each other to form a crossing arrangement. The second metal spring plates 4 have an opposite end extending into the second wire holes 21 and are each bent in a direction toward a center of the second wire holes 21 to form the wire insertion spring plates 43 for receiving insertion of and establishing connection with the conductor wires 6.

To use the second embodiment of the present invention, the PCB 7 is soldered to the soldering legs 37 of the first metal spring plates 3 to form electrical connection therebetween; and the conductor wires 6 are inserted into the second wire holes 21 to physically engage the wire insertion spring plates 43 of the second metal spring plates 4 and thus form electrical connection therebetween. Then, the insertion legs 12 of the first plastic core 1 are respectively inserted into the second insertion holes 23 of the socket 22 of the second plastic core 2 such that the plugging spring plates 32 of the first metal spring plates 3 and the plugging spring plates 42 of the second metal spring plates 4 are inter-plugged into each other and coupled together to realize electrical connection therebetween. This helps greatly simplify electrical connection of a wire (cable) to a board.

Figure 10:
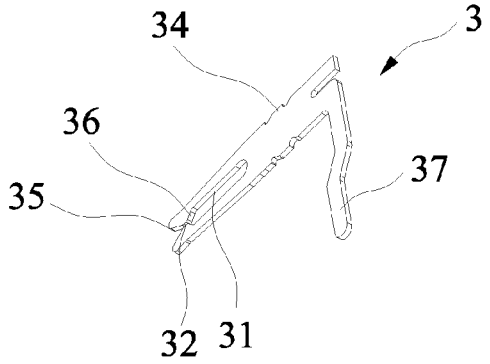
FIG. 10 is a perspective view of first metal spring plates of the third embodiment.
Figures 1, 11:
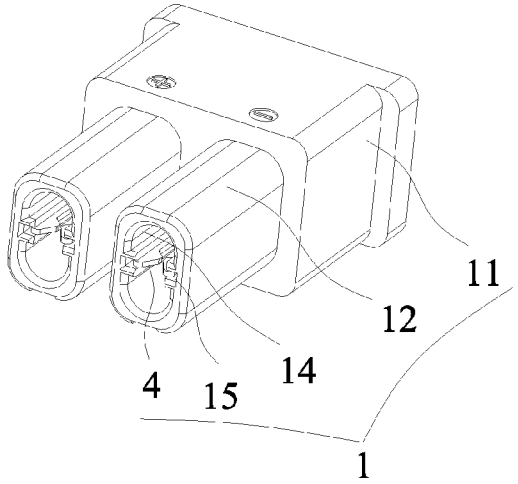
Figures 2, 11:
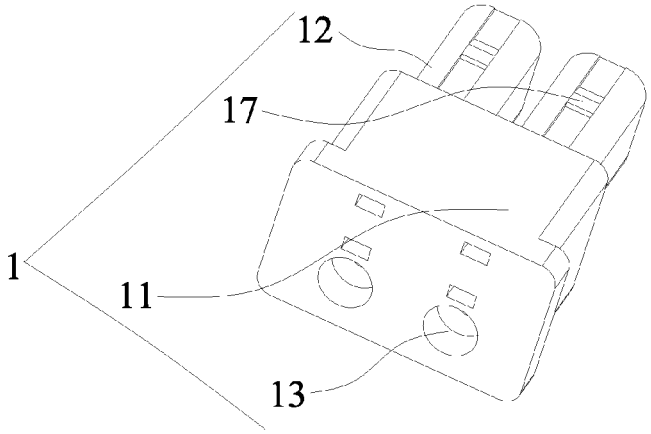
Figures 3, 11:
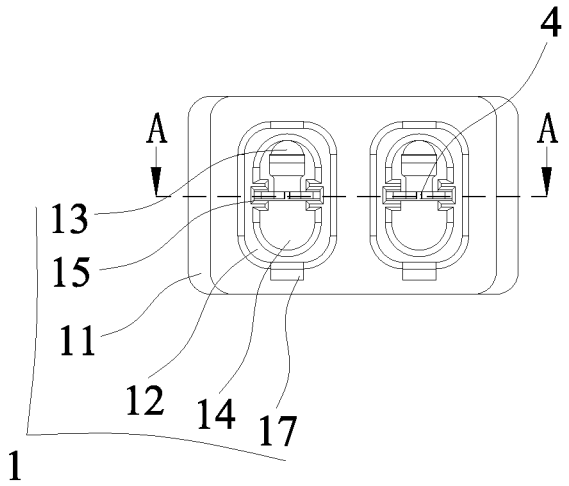
Figures 4, 11:
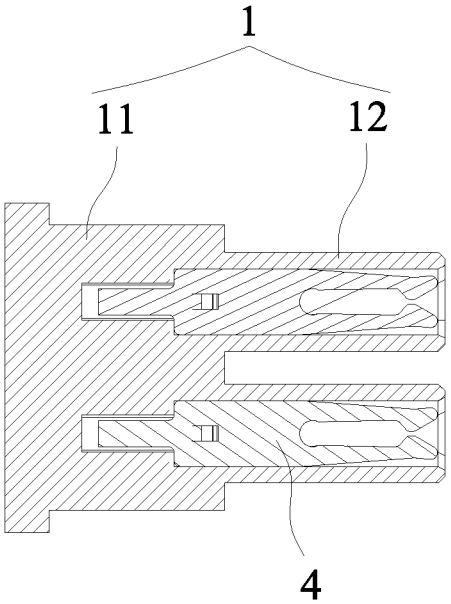
Figures 5, 11:
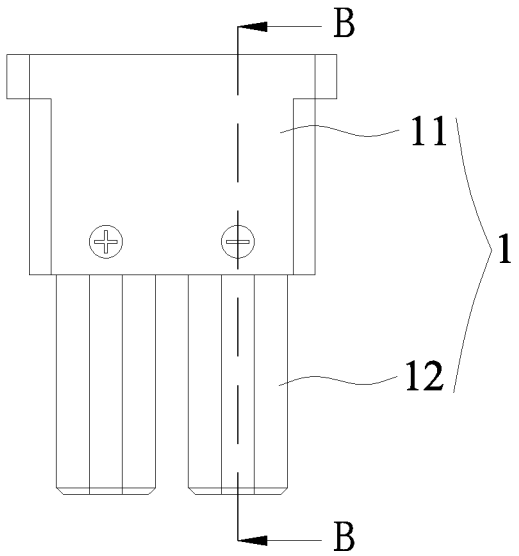
Figures 6, 11:
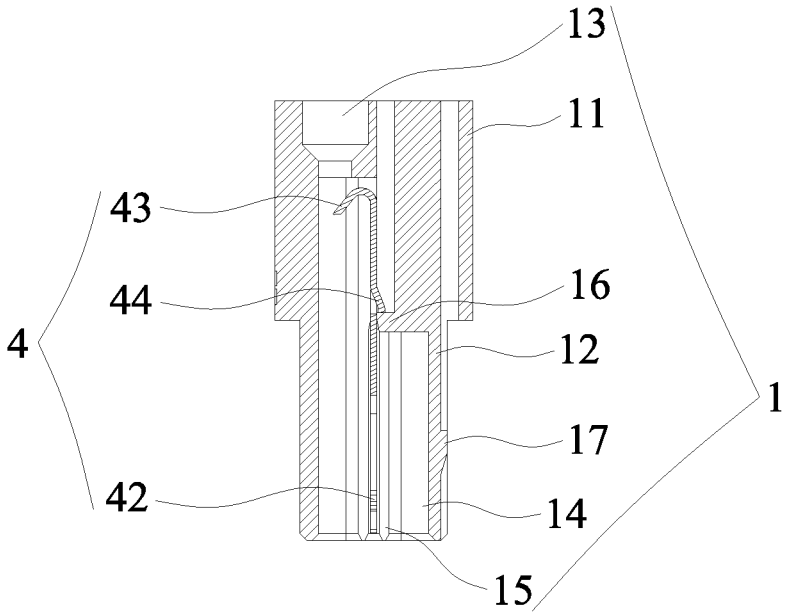
Figures 1, 12:
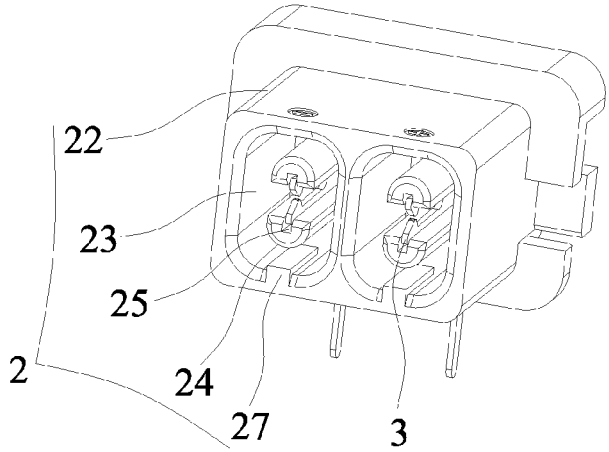
Figures 2, 12:
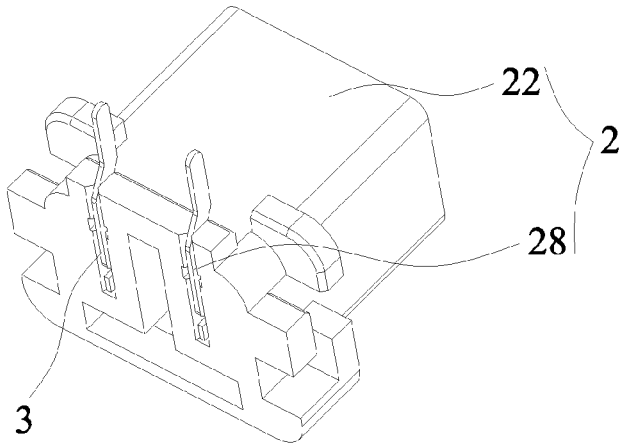
Figures 3, 12:
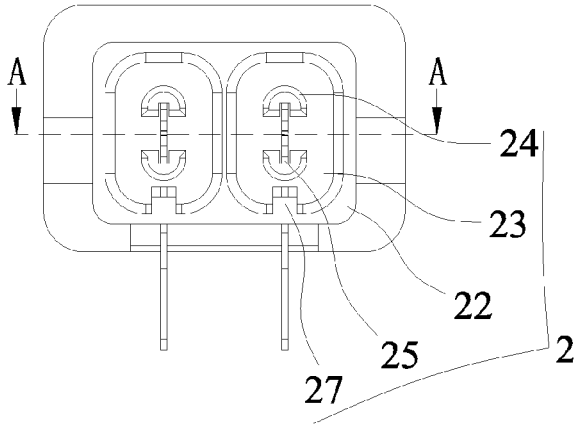
Figures 4, 12:
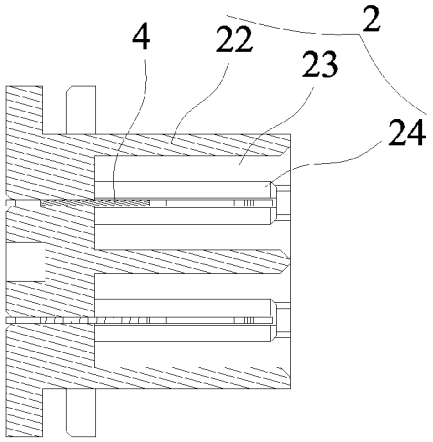
Figures 5, 12:
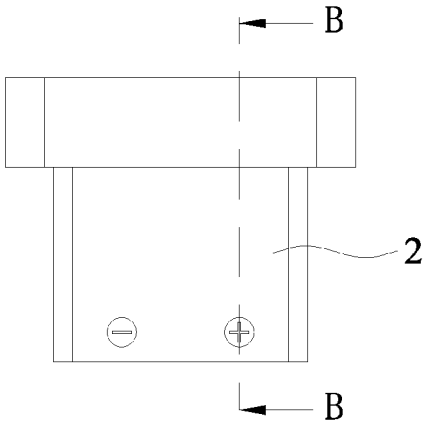
Figures 6, 12:
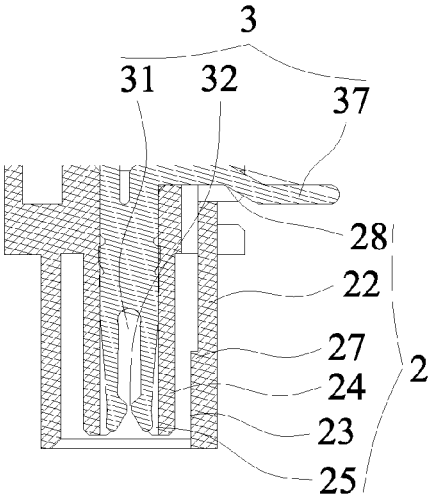

As shown in FIG. 9 to FIG. 12-6, a third embodiment of the present invention is shown, providing a wire-to-board male-female mutually-pluggable connector, which comprises a first plastic core 1, a second plastic core 2, first metal spring plates 3 (as shown in FIG. 10), and second metal spring plates 4 (similar to the counterparts of the first embodiment as shown in FIG. 2-1 and FIG. 2-2).

The first metal spring plates 3 and the second metal spring plates 4 are each formed with a slot 31, 41 in one end portion thereof such that the slot 31, 41 has an opening that is formed with plugging spring plates 32, 42 that are protruded toward and opposite to each other. The first metal spring plates 3 are formed, at an opposite end thereof, with a bent or curved soldering leg 37, while the second metal spring plates 4 are formed, at an opposite end thereof, with a curved or bent wire insertion spring plate 43. The instant embodiment is different from the second embodiment in that the first metal spring plates 3 have an opposite end that is bent or curved sideways to form a soldering leg 37, such that the soldering leg 37 and the plugging spring plates 32 are located on the same plane.

The first plastic core 1 comprises a base seat 11 and insertion legs 12. The base seat 11 is formed therein with first wire holes 13 for receiving insertion of conductor wires 6 therein. The insertion legs 12 are respectively formed with first insertion holes 14 that are connected to and in communication with the first wire holes 13, respectively. The first insertion hole 14 receive and fix the second metal spring plates 4 therein, respectively, such that the plugging spring plates 42 of the second metal spring plates 4 are located in the first insertion hole 14 and an opposite end of the second metal spring plates 4 extends into the first wire hole 13 and is bent in a direction toward a center of the first wire hole 13 to form the wire insertion spring plates 43 for receiving insertion of and establishing connection with the conductor wires 6.

The second plastic core 2 has an opposite end formed as a socket 22. The socket 22 comprises second insertion holes 23 that receive the insertion legs 12 to plug therein. The second insertion holes 23 extend through the second plastic core 2. The second insertion holes 23 receive and fix the first metal spring plates 3 therein, respectively, at a middle thereof. The plugging spring plates 32 of the first metal spring plates 3 are located in the second insertion hole 23 such that the plugging spring plates 32 of the first metal spring plates 3 and the plugging spring plates 42 of the second metal spring plates 4 are allowed, through insertion, to intersect each other to form a crossing arrangement. The first metal spring plates 3 have an opposite end extending through the second insertion holes 23 to project out of an end of the second plastic core 2 to be bent or curved to form the soldering leg 37 for connection with a the PCB 7.

To use the third embodiment of the present invention, the PCB 7 is soldered to the soldering legs 37 of the first metal spring plates 3 to form electrical connection therebetween; and the conductor wires 6 are inserted into the first wire hole 13 to physically engage the wire insertion spring plates 43 of the second metal spring plates 4 and thus form electrical connection therebetween. Then, the insertion legs 12 of the first plastic core 1 are respectively inserted into the second insertion holes 23 of the socket 22 of the second plastic core 2 such that the plugging spring plates 32 of the first metal spring plates 3 and the plugging spring plates 42 of the second metal spring plates 4 are inter-plugged into each other and coupled together to realize electrical connection therebetween. This helps greatly simplify electrical connection of a wire (cable) to a board.

To simplify assembly and fixation, the second and third embodiments of the present invention comprise the following improved designs, which help molding, processing, and assembling, and make a stable structure to achieve secure electrical connection and saving of material.

The first plastic core 1 (for the second embodiment) is formed with positioning and retention grooves 18 respectively corresponding to the soldering legs 37 to receive and retain the soldering legs 37 therein; or alternatively, the second plastic core 2 (for the third embodiment) is formed with positioning and retention grooves 28 respectively corresponding to the soldering legs 37 to receive and retain the soldering legs 37 therein.

The first insertion holes 14 of the first plastic core 1 are each formed, in an inside wall thereof, with first fixing grooves 15, and the first metal spring plates 3 (the second embodiment) or the second metal spring plates 4 (the third embodiment) are inserted into and fixed by the first fixing grooves 15.

The second insertion holes 23 of the second plastic core 2 are each formed therein with two support pillars 24 that are opposite to each other and have a predetermined gap formed therebetween. The two the support pillars 24 are respectively formed with second fixing grooves 25 that are opposite to each other. The second metal spring plate 4 (the second embodiment) or the first metal spring plate 3 (the third embodiment) is inserted into and fixed by the second fixing grooves 25. In the second embodiment, the plugging spring plates 42 of the second metal spring plate 4 correspond exactly to the gap between the support pillars 24. The gap allows the plugging spring plates 32 of the first metal spring plate 3 to insert therein; in the third embodiment, the plugging spring plates 32 of the first metal spring plate 3 correspond exactly to the gap between the support pillars 24 and the gap allows the plugging spring plates 42 of the second metal spring plate 4 to insert therein.

The first embodiment, the second embodiment and the third embodiment further comprise the following improved designs to facilitate processing and assembling and to make the structure more stable:

The first metal spring plates 3 and the second metal spring plates 4 are formed with barbs 34, 44, and the first plastic core 1 and the second plastic core 2 are formed therein with corresponding positioning blocks 16, 26, such that the barbs 34, 44 and the positioning blocks 16, 26 are collaboratively engageable with each other to more securely fix the first metal spring plates 3 and the second metal spring plates 4 in the first plastic core 1 and the second plastic core 2.

An outside surface of the insertion legs 12 of the first plastic core 1 and an inside wall of the second insertion holes 23 of the socket 22 of the second plastic core 2 are respectively formed with retention blocks 17, 27, which are engageable with each other such that the retention blocks 17, 27 help secure the first plastic core 1 and the second plastic core 2 fixedly in position after insertion to each other.

The first metal spring plates 3 and the second metal spring plates 4 are each formed with an introduction guide angle 35, 45 at an entrance opening of the plugging spring plates 32, 42 to allow for easy insertion and are each also formed with a withdrawal guide angle 36, 46 to help withdrawal.

According to the present invention, the first plastic core 1 comprises two first insertion legs 12, and correspondingly, the socket 22 of the second plastic core 2 comprises two second insertion holes 23. The numbers of the first insertion legs 12 and the second insertion holes 23 of the socket 22 are not limited to what shown in the drawings and may be changed according to design requirements.

Figures 1, 13:
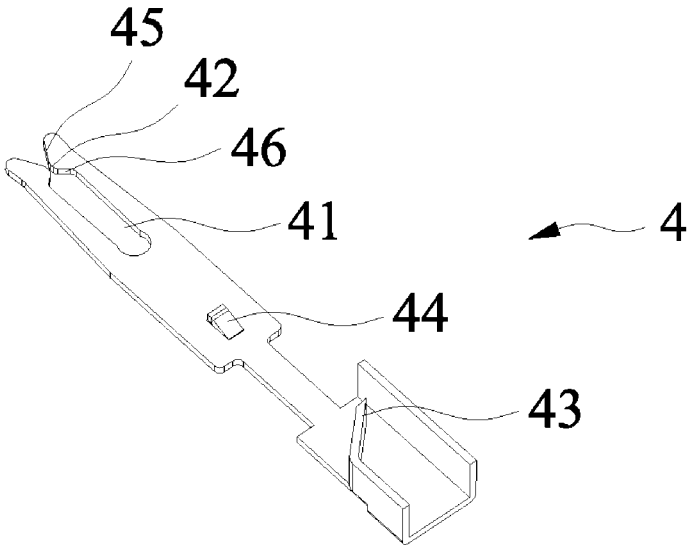
Figures 2, 13:
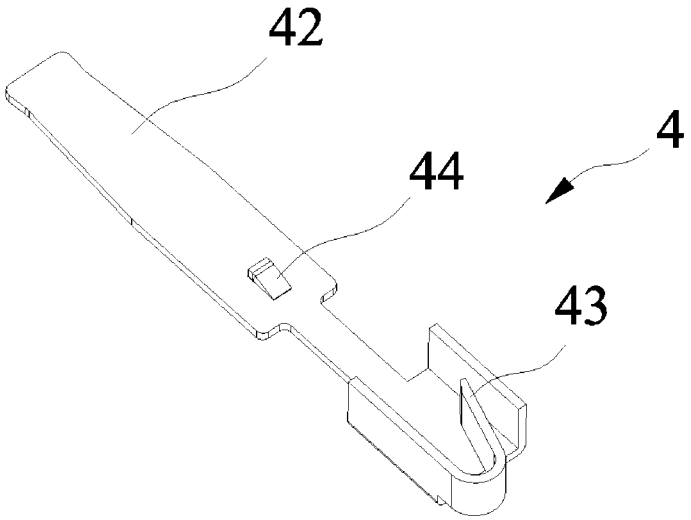
Figures 4, 13:
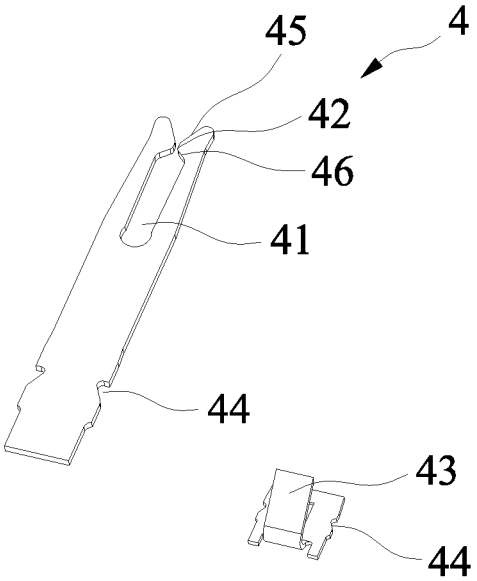
Figures 4, 13:
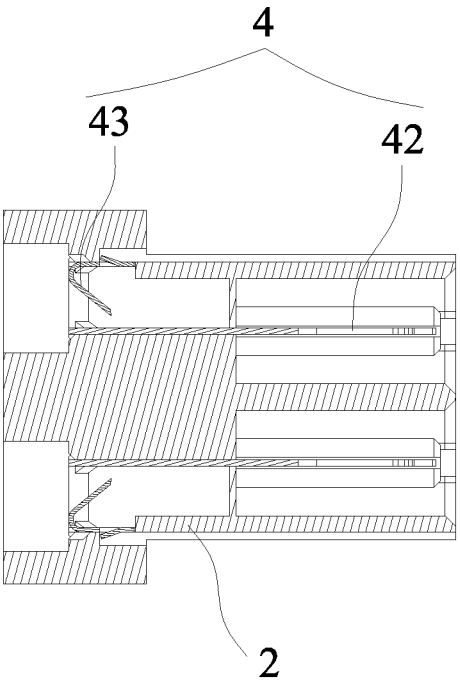

In addition to the bent or curved form shown and described above, in the present invention, the wire insertion spring plates 33, 43 of the first metal spring plates 3 and the second metal spring plates 4 may be alternatively structured in other bent or curved configurations that demonstrate elasticity allowing insertion of and electrical connection with conductor wires. Taking the second metal spring plates 4 as an example, they can be bent, an integrated and unitary structure, as illustrated in FIG. 13-1 and FIG. 13-2. Further, in the present invention, the wire insertion spring plates 33, 43 of the first metal spring plates 3 and the second metal spring plates 4, in addition to the integrally formed unitary structure as the above described plugging spring plates 32, 42, may be structured as a separate arrangement, which, with the second metal spring plates 4 as an example, can be a separate bent or curved configuration, as shown in FIG. 13-3 and FIG. 13-4, in which a separate wire insertion spring plate 43 and an extension section of the plugging spring plate 42 cooperate with each other to receive the conductor wire 5, 6 to insert therebetween. It is apparent that the first embodiment may be modified such that one of the wire insertion spring plates 33 (or 43) is of a unitary configuration, while the other one of the wire insertion spring plates 43 (or 33) is of a separate configuration.

Further, in the present invention, the plugging spring plates 32, 42 of the first metal spring plates 3 and the second metal spring plates 4, in addition to the spear configuration described above (namely including the slot 31, 41 to form the plugging spring plates 32, 42), can be arranged such that one is of the spear configuration, while the other one does not include the slot and is directly formed as a plugging spring plate 32, 42, wherein, with the second metal spring plate 4 as an example, as shown in FIG. 13-2, the second metal spring plate 4 is not provided with a slot and is directly formed as a plugging spring plate 42, and what is necessary in this invention is that the two plugging spring plates 32, 42 can intersect, through insertion, with each other to form crossing arrangement for establishing electrical connection therebetween.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A male-female mutually-pluggable connector, comprising a first plastic core, a second plastic core, first metal spring plates, and second metal spring plates, wherein the first metal spring plates and the second metal spring plates are each provided, on one end thereof, with plugging spring plates and are provided, on an opposite end, with a curved wire insertion spring plate, at least one of the first metal spring plates and the second metal spring plates being formed, in one end portion thereof, with a slot such that the slot has an opening having opposite sides raised and protruding toward each other to form the plugging spring plates; the first plastic core comprises a base seat and insertion legs, the base seat being formed therein with first wire holes for receiving insertions of conductor wires, the insertion legs being formed with first insertion holes in communication with the first wire holes, the first insertion holes respectively receiving and fixing the first metal spring plates therein at a middle thereof such that the plugging spring plates of the first metal spring plates are located in the first insertion holes and the wire insertion spring plates of the first metal spring plates are located in the first wire holes for receiving the insertion of the conductor wires; the second plastic core has one end formed with second wire holes for receiving insertion of conductor wires, the second plastic core having an opposite end forming a socket, wherein the socket comprises second insertion holes formed therein for receiving the insertion legs to plug therein, the second insertion holes respectively receiving and fixing the second metal spring plates therein at a middle thereof such that the plugging spring plates of the second metal spring plates are located in the second insertion hole to allow the plugging spring plates of the first metal spring plates and the plugging spring plates of the second metal spring plates to intersect with each other in a crossing configuration, the wire insertion spring plates of the second metal spring plates being located in the second wire holes to receive the insertion of and connection with the conductor wires; wherein when the insertion legs of the first plastic core are plugged into the second insertion holes of the socket of the second plastic core, the plugging spring plates of the first metal spring plates and the second metal spring plates are inter-plugged into each other and coupled together to realize wire-to-wire electrical connection.

2. The male-female mutually-pluggable connector according to claim 1, wherein the wire insertion spring plates of the second metal spring plates are integrally formed with the plugging spring plates.

3. The male-female mutually-pluggable connector according to claim 1, wherein the wire insertion spring plates of the second metal spring plates are separate from the plugging spring plates and wire insertion spring plates cooperate with extension sections of the plugging spring plates to receive the conductor wires to insert therein.

4. The male-female mutually-pluggable connector according to claim 1, wherein the wire insertion spring plate of one of the first metal spring plate and the second metal spring plate is integrally formed with the plugging spring plate, while that of the other one is separate from the plugging spring plate, wherein the separate wire insertion spring plate cooperates an extension section of the plugging spring plate to receive the conductor wire to insert therein.

5. The male-female mutually-pluggable connector according to claim 1, wherein the first insertion holes of the first plastic core each have an inside wall in which first fixing grooves are formed, the first metal spring plate being inserted into the first fixing grooves to divide the first insertion hole into two halves, wherein one of the two halves of the first insertion hole where the insertion spring plates of the first metal spring plate are located is in communication with the first wire hole.

6. The male-female mutually-pluggable connector according to claim 1, wherein the second insertion holes of the second plastic core are each provided therein with two support pillars that are opposite to each other and are spaced from each other by a predetermined gap, the two support pillars formed with second fixing grooves, the second metal spring plate being inserted into the second fixing grooves, such that the plugging spring plates of the second metal spring plates correspond to the gap of the support pillars, wherein the second insertion hole is set in communication with the second wire hole at a location corresponding to the wire insertion spring plates of the second metal spring plate.

7. A male-female mutually-pluggable connector, comprising a first plastic core, a second plastic core, first metal spring plates, and the second metal spring plates, wherein the first metal spring plates and the second metal spring plates are each provided, on one end thereof, with plugging spring plates, the first metal spring plates and the second metal spring plates being respectively provided, on an opposite end thereof, with a soldering leg and a curved wire insertion spring plate, at least one of the first metal spring plates and the second metal spring plates being formed, at one end portion thereof, with a slot, the slot having an opening having opposite sides raised and protruding toward each other to form the plugging spring plates; the first plastic core comprises a base seat and insertion legs, the insertion legs being formed with first insertion holes extending through the base seat, the first insertion holes receiving and fixing, in a middle thereof, the first metal spring plate, such that the plugging spring plates of the first metal spring plates are located in the first insertion hole and an opposite end of the first metal spring plate extends through the first insertion hole and projects out of the base seat to be curved to form the soldering leg for connection with a printed circuit board (PCB); the second plastic core has an end formed with second wire holes for receiving insertion of conductor wires, the second plastic core having an opposite end that forms a socket, the socket comprising second insertion holes formed therein for receiving the insertion legs to plug therein, the second insertion holes receiving and fixing, in a middle thereof, the second metal spring plates, such that the plugging spring plates of the second metal spring plates are located in the second insertion holes to allow the plugging spring plates of the first metal spring plates and the plugging spring plates of the second metal spring plates to intersect each other in a crossing configuration, the wire insertion spring plates of the second metal spring plates being located in the second wire holes for receiving insertion of and connection with the conductor wires; wherein when the insertion legs of the first plastic core are plugged into the second insertion holes of the socket of the second plastic core, the plugging spring plates of the first metal spring plates and the second metal spring plates are inter-plugged into each other and coupled together to realize wire-to-board electrical connection.

8. The male-female mutually-pluggable connector according to claim 7, wherein the opposite end of the first metal spring plates is curved sideways to form the soldering leg, the soldering leg and the plugging spring plates being located on the same plane.

9. The male-female mutually-pluggable connector according to claim 7, wherein the opposite end of the first metal spring plates is curved downward to form the soldering leg, the soldering leg defining an included angle with respect to a plane on which the plugging spring plates are located.

10. The male-female mutually-pluggable connector according to claim 7, wherein the wire insertion spring plates of the second metal spring plates are integrally formed with the plugging spring plates.

11. The male-female mutually-pluggable connector according to claim 7, wherein the wire insertion spring plates of the second metal spring plates are separate from the plugging spring plates and wire insertion spring plates cooperate with extension sections of the plugging spring plates to receive the conductor wires to insert therein.

12. The male-female mutually-pluggable connector according to claim 7, wherein the first insertion holes of the first plastic core each have an inside wall in which first fixing grooves are formed, the first metal spring plate being inserted into the first fixing grooves.

13. The male-female mutually-pluggable connector according to claim 7, wherein the first insertion holes of the first plastic core each have an inside wall in which first fixing grooves are formed, the second metal spring plate being inserted into the first fixing grooves.

14. A male-female mutually-pluggable connector, comprising a first plastic core, a second plastic core, first metal spring plates, and the second metal spring plates, wherein the first metal spring plates and the second metal spring plates are each provided, on one end thereof, with plugging spring plates, the first metal spring plates and the second metal spring plates being respectively provided, on an opposite end thereof, with a soldering leg and a curved wire insertion spring plate, at least one of the first metal spring plates and the second metal spring plates being formed, at one end portion thereof, with a slot, the slot having an opening having opposite sides raised and protruding toward each other to form the plugging spring plates; the first plastic core comprises a base seat and insertion legs, the base seat being formed with first wire holes for receiving insertion of conductor wires, the insertion legs being formed with first insertion holes in communication with the first wire holes, the first insertion holes receiving and fixing, in a middle thereof, the second metal spring plates, such that the plugging spring plates of the second metal spring plates are located in the first insertion holes and the wire insertion spring plates of the second metal spring plates are located in the first wire holes for receiving insertion of conductor wires; the second plastic core has one end forming a socket, the socket comprising second insertion holes extending through the second plastic core for receiving the insertion legs to plug therein, the second insertion holes receiving and fixing, in a middle thereof, with first metal spring plates, such that the plugging spring plates of the first metal spring plates are located in the second insertion hole to allow the plugging spring plates of the first metal spring plates and the plugging spring plates of the second metal spring plates to intersect each other in a crossing configuration, the first metal spring plates having an opposite end extending through the second insertion holes to project out of an end of the second plastic core to be curved to form a soldering leg for connection with a printed circuit board (PCB); wherein when the insertion legs of the first plastic core are plugged into the second insertion holes of the socket of the second plastic core, the plugging spring plates of the first metal spring plates and the second metal spring plates are inter-plugged into each other and coupled together to realize wire-to-board electrical connection.

15. The male-female mutually-pluggable connector according to claim 14, wherein the opposite end of the first metal spring plates is curved sideways to form the soldering leg, the soldering leg and the plugging spring plates being located on the same plane.

16. The male-female mutually-pluggable connector according to claim 14, wherein the opposite end of the first metal spring plates is curved downward to form the soldering leg, the soldering leg defining an included angle with respect to a plane on which the plugging spring plates are located.

17. The male-female mutually-pluggable connector according to claim 14, wherein the wire insertion spring plates of the second metal spring plates are integrally formed with the plugging spring plates.

18. The male-female mutually-pluggable connector according to claim 14, wherein the wire insertion spring plates of the second metal spring plates are separate from the plugging spring plates and wire insertion spring plates cooperate with extension sections of the plugging spring plates to receive the conductor wires to insert therein.

19. The male-female mutually-pluggable connector according to claim 14, wherein the first insertion holes of the first plastic core each have an inside wall in which first fixing grooves are formed, the first metal spring plate being inserted into the first fixing grooves.

20. The male-female mutually-pluggable connector according to claim 14, wherein the first insertion holes of the first plastic core each have an inside wall in which first fixing grooves are formed, the second metal spring plate being inserted into the first fixing grooves.

* * * * *